US005913736A

United States Patent [19]

Maehara et al.

[11] Patent Number: 5,913,736

[45] Date of Patent: Jun. 22, 1999

[54] GOLF BALL

[75] Inventors: Kazuto Maehara; Toshio Chikaraishi, both of Saitama, Japan

[73] Assignee: Bridgestone Sports Co., Ltd, Tokyo, Japan

[21] Appl. No.: 08/871,961

[22] Filed: Jun. 10, 1997

[30] Foreign Application Priority Data

Jun. 14, 1996 [JP] Japan ..... 8-175985

[51] Int. Cl.[6] ..... A63B 37/06

[52] U.S. Cl. ..... 473/360; 473/373

[58] Field of Search ..... 473/372, 373, 473/385, 360, 359

[56] References Cited

U.S. PATENT DOCUMENTS

| | | | |
|---|---|---|---|
| 711,177 | 10/1902 | Richards | 473/359 X |
| 1,568,514 | 1/1926 | Lewis | 473/360 |
| 4,935,068 | 6/1990 | Duerig | 473/372 |
| 5,713,801 | 2/1998 | Aoyama | 473/360 X |
| 5,720,754 | 2/1998 | Middleman et al. | 473/372 X |

*Primary Examiner*—George J. Marlo

*Attorney, Agent, or Firm*—Sughrue, Mion, Zinn Macpeak & Seas, PLLC

[57] ABSTRACT

There is disclosed a golf ball including a layer made of a shape memory alloy. For example, fine thread of a shape memory alloy is wound around a core so as to provide a shape memory alloy layer between the core and a cover of the golf ball. In this structure, the shape memory alloy layer provides an effect of tightening the core, thus improving the golf ball's resiliency, resulting an increased travel distance. Moreover, since the shape memory alloy layer has a high specific gravity, the moment of inertia of the golf ball increases, so that the spin and roll performances of the golf ball are improved. Furthermore, the shape memory alloy layer having higher strength and hardness functions as a reinforcement layer of the cover, thereby improving cut resistance and impact durability of the cover.

6 Claims, 1 Drawing Sheet

GOLF BALL

BACKGROUND OF THE INVENTION

1. Field of the Invention

The present invention relates to a golf ball such as a solid golf ball or a thread-wound golf ball.

2. Related Art

Solid golf balls such as two-piece golf balls and three-piece golf balls are, in general, produced by a process that comprises enclosing a solid core or a thread-wound core with a cover material while forming dimples on the cover material by compression or injection molding, followed by coating the surface of the cover material. This is conducting mark stamping, and coating the outermost layer of the ball.

The golf balls according to the prior art are produced mainly from plastic and rubber materials. The solid golf ball is constructed such that a solid core composed of a single layer or a plurality of layers is coated with a cover composed of a single layer or a plurality of layers. Each layer of the solid core and the cover is made of plastic or rubber.

The thread-wound golf ball is constructed such that a thread-wound core, which is composed of a liquid or solid center and thread rubber (rubber materials) wound therearound, is coated with a cover composed of a single layer or a plurality of layers. The liquid center is composed of a spherical bag formed of rubber and some liquid enclosed in the bag. The solid center is produced such that rubber is formed into a spherical shape. Each layer of the cover is constructed of plastic or rubber.

According to the prior art, since golf balls are produced only with plastic and rubber materials (although liquid is present in the thread-wound golf ball comprising a liquid center), desired properties cannot be imparted to the golf balls.

SUMMARY OF THE INVENTION

The present invention is made in view of the above-mentioned problem in the prior art. An object of the present invention is to provide a golf ball having certain properties not possessed by a golf ball produced only with plastic and rubber, and to provide a golf ball capable of overcoming problems suffered by a golf ball produced only with plastic and rubber.

To achieve the above object, the present invention provides a golf ball including one or more layers made of a shape memory alloy (hereinafter referred to as "a shape memory alloy layer").

According to the present invention, a golf ball is provided with a shape memory alloy layer, so that, with an effect provided by the layer, the golf ball is imparted with certain properties not possessed by a golf ball made only with plastic and rubber. Further, the golf ball according to the present invention overcomes problems suffered by the prior art. That is, by utilizing properties of the shape memory alloy and placing the shape memory alloy layer in a selected location, the golf ball according to the present invention can be imparted with certain properties that improve travel properties, spin properties, and feel on impact thereof A shape memory alloy layer has a shape memory effect, that is, after deformation, it tends to return to the original shape as it is heated. In addition to this effect, the present inventors noted that a shape memory alloy layer has a superelasticity (pseudoelasticity); that is, at certain temperatures, the shape memory alloy layer appears to be plastically deformed when a load is applied, but its strain is removed due to reverse transformation when the load is removed. The inventors have discovered that, by taking advantage of the superelasticity, golf balls can be provided with a hoop effect and a reinforcement effect, both of which will be described later.

When a shape memory alloy layer is provided between a core and a cover, the shape memory alloy layer functions to tighten the core, so that the resiliency of the golf ball improves and the travel distance increases. Further, the moment of inertia thereof increases by an effect of the shape memory alloy layer having a high specific gravity. As a result, the spin and roll performances of the golf ball are improved. Further, the shape memory alloy layer having higher strength and hardness functions as a reinforcement layer of the cover, thereby improving cut resistance and impact durability of the cover.

DESCRIPTION OF THE PREFERRED EMBODIMENT

Figure 1:
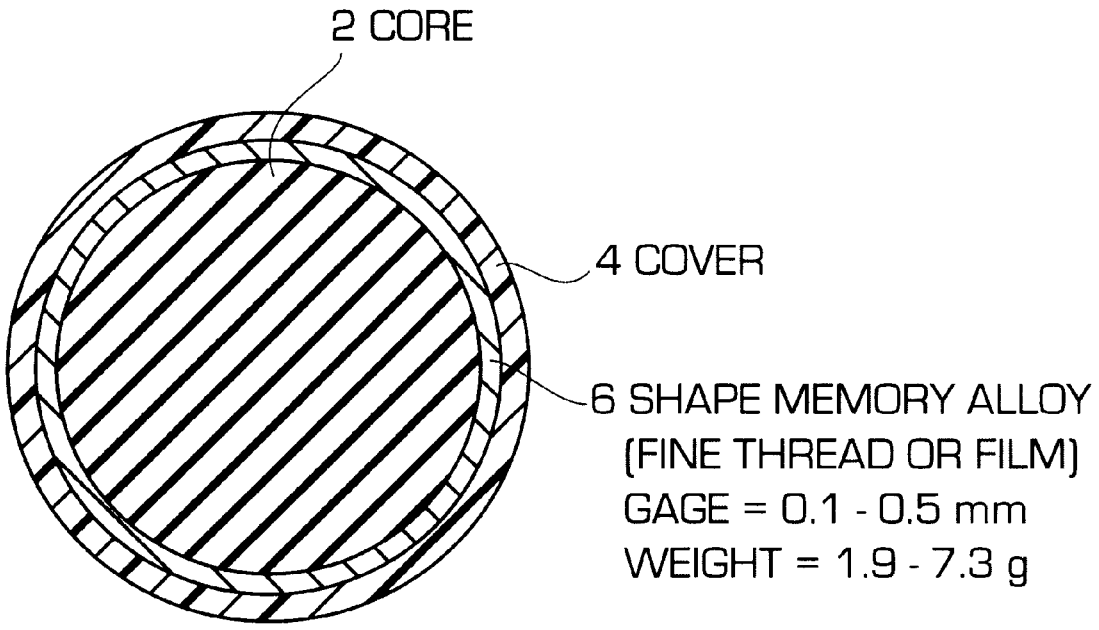
FIG. 1 shows a sectional view of a golf ball according to a preferred embodiment of the present invention.

In the present invention, no limitation is imposed on the kind of shape memory alloy which forms a shape memory alloy layer; it may be selected from among Ag—Cd shape memory alloy, Au—Cd shape memory alloy, Cu—Al—Ni shape memory alloy, Cu—Au—Zn shape memory alloy, Cu—Sn shape memory alloy, Cu—Zn shape memory alloy, Cu—Zn—X shape memory alloy (X=Si, Sn, Al or Ga), In—Tl shape memory alloy, Ni—Al shape memory alloy, Ti—Ni shape memory alloy, Fe—Pt shape memory alloy, and Fe—Pd shape memory alloy. Among these shape memory alloys, shape memory alloys comprising Ni, particularly Ti—Ni, are preferable because they exhibit a high elastic extension, as high as 5% to 6%.

In the present invention, no limitation is placed on the position of a shape memory alloy layer; for example, it may be disposed in the vicinity of the outer surface of the golf ball, in the vicinity the center portion thereof, or between the outer surface and the center portion. The golf ball of the present invention may comprise either a single memory alloy layer or a plurality of memory alloy layer layers.

As shown in FIG. 1, a preferred embodiment of the golf ball according to the present invention comprises a core 2 which may be a solid core or a thread-wound core; a cover 4 formed with a single layer or a plurality of layers, and a shape memory alloy layer 6 positioned between the core 2 and the cover 4. According to this preferred embodiment, the shape memory alloy layer 6 provides the following effects.

(1) The shape memory alloy layer 6 functions to tighten the core 2 of the golf ball, so that the resiliency of the golf ball improves and the travel distance increases accordingly (the hoop effect).

(2) The shape memory alloy layer 6 having a high specific gravity is positioned near the outer surface and far from the center of a golf ball, so that the moment of inertia of the golf ball increases and the spin and rolling performances thereof improve (effect of increased moment of inertia).

(3) The shape memory alloy layer 6 having a high strength and hardness is disposed inside the cover 4 of the golf ball, so that the shape memory alloy layer 6 functions as a reinforcing layer of the cover 4, thereby improving cut resistance and impact durability of the cover 4 (cover reinforcement effect).

A solid golf ball of a super-spin type, which is formed by coating a soft cover over a soft solid core, is so soft that it does not have sufficient resiliency, resulting in a decreased travel distance. On the other hand, as shown in FIG. 1, in the golf ball of the present invention, which is composed of a soft solid core, a soft cover and a the shape memory alloy layer 6 positioned between the core and the cover, the layer 6 provides various effects such as the abovedescribed hoop effect, effect of increased moment of inertia, and cover reinforcement effect. As a result, there is provided a super-spin solid golf ball with soft feeling, having a satisfactory travel distance, excellent spin and rolling performances, as well as improved cut resistance and impact durability.

In the present invention, no limitation is placed on the shape of the shape memory alloy forming a shape memory alloy layer; it may be formed of fine thread type shape memory alloy or film type shape memory alloy, with the fine thread type of shape memory alloy being preferable. That is, when a shape memory alloy layer is formed by winding the fine thread type of shape memory alloy, there results an improved effect of the shape memory alloy layer tightening the inner layer thereof (the hoop effect). For example, in the preferred embodiment shown in FIG. 1, the golf ball comprises a shape memory alloy layer 6 formed by winding the fine thread type of shape memory alloy between the core 2 and the cover 4, so that the layer 6 has an improved effect of tightening the core 2, thus improving the golf ball's resiliency, resulting an increased travel distance.

The fine thread type of shape memory alloy preferably has a circular cross section, but may alternatively be formed in a flat shape having a gourd-shaped cross section. In the case where fine thread of shape memory alloy is wound around the core 2, it is preferred that prior to winding, the fine thread of shape memory alloy be lengthened by, at least 0.5% of its original length (the length while no external force is loaded). More preferably, it should be lengthened 0.5 to 3% before winding. Through such an arrangement, the fine thread of shape memory alloy can be wound more smoothly, and the shape memory alloy layer of the resultant golf ball can provide the greatest reinforcement effect.

No limitation is placed on the thickness and weight of the shape memory alloy layer, and they may be arranged in consideration of advantages obtained from the properties of the shape memory alloy and the weight of the shape memory alloy layer. Generally, the thickness of the shape memory alloy layer is determined to fall within the range from 0.1 mm to 0.5 mm, and the weight thereof is determined to fall within the range from 1.9 g to 7.3 g. The overall size and weight of a golf ball according to the present invention follow the applicable golf regulations; diameter may be at least 42.67 mm, and weight 45.92 g or less.

EXAMPLES

A two-piece golf ball as shown in FIG. 1 was manufactured. The solid core 2 was prepared through use of a base rubber of cis-1,4-polybutadiene (100 parts by weight), zinc acrylate (35 parts by weight), zinc oxide (5 parts by weight), antioxidant (0.2 parts by weight), dicumyl peroxide (0.9 parts by weight), and a proper amount of barium acetate. The solid core had a shore D hardness of 50. The shape memory alloy layer 6 was formed by winding around the solid core 2 fine thread made of Ti—Ni shape memory alloy having a diameter of 0.1 mm (Product of Nihon Seisen Co., Ltd. tradename: Rememballoy). The thickness of the layer 6 was approximately 1 mm. The cover 4 was made by compression molding using an ionomer resin (Product of DuPont-Mitsui Polychemical Co., Ltd. Tradename: Himilan). The cover 4 had a Shore D hardness of 55.

The golf ball formed as described above was a super-spin type solid golf ball with soft feeling and possessing a satisfactory travel distance, excellent spin and rolling properties, and improved cut resistance and impact durability; whereas a two-piece golf ball composed of a core and a cover that were made of materials same as those of the golf ball of the present embodiment was so soft that sufficient resiliency could not be obtained, and its travel distance was short.

What is claimed is:

1. A golf ball comprising a core, a shape memory alloy layer formed by winding a fine thread of Ti—Ni shape memory alloy around the core, and a cover surrounding the shape memory alloy layer.

2. A golf ball according to claim 1, wherein Ti—Ni shape memory alloy has an elastic extension of 5% to 6%.

3. A golf ball according to claim 1, wherein said shape memory alloy layer has a thickness of 0.1 mm to 0.5 mm.

4. A golf ball according to claim 1, wherein said shape memory alloy layer has a weight of 1.9 g to 7.3 g.

5. A golf ball according to claim 1, wherein said fine thread of a shape memory alloy has an initial length before winding that is 0.5 to 3% longer than a final wound length.

6. A golf ball according to claim 1, wherein said fine thread of a shape memory alloy has a circular cross section.

* * * * *